United States Patent [19]

Föhl

[11] 4,112,996

[45] Sep. 12, 1978

[54] SAFETY DEVICE FOR ARRESTING UNROLLING OF ROLLER BLINDS

[75] Inventor: Artur Föhl, Haubersbronn, Germany

[73] Assignee: Repa Feinstanzwerk GmbH, Aldorf, Germany

[21] Appl. No.: 860,300

[22] Filed: Dec. 14, 1977

Related U.S. Application Data

[63] Continuation-in-part of Ser. No. 692,275, Jun. 3, 1976, abandoned.

[30] Foreign Application Priority Data

Jun. 3, 1975 [DE] Fed. Rep. of Germany ..... 2524421

[51] Int. Cl.[2] ..... E06B 9/208

[52] U.S. Cl. ..... 160/296; 160/300; 160/302

[58] Field of Search ..... 160/7, 8, 9, 300, 291, 160/296, 302

[56] References Cited

U.S. PATENT DOCUMENTS

| | | | |
|---|---|---|---|
| 201,023 | 3/1878 | Lake | 160/296 |
| 343,160 | 6/1886 | Buckley | 160/296 |
| 826,284 | 7/1906 | Smith et al. | 160/296 |
| 1,709,305 | 4/1929 | Brunst et al. | 160/7 |
| 2,040,301 | 5/1936 | Fay | 160/296 |

*Primary Examiner*—Peter M. Caun

*Attorney, Agent, or Firm*—Herbert L. Lerner

[57] ABSTRACT

A roller blind with a safety device for arresting accidental unrolling of the blind in which a concentric blocking shaft is affixed to the winding shaft, a gear fastened to the blocking shaft, a pivotally mounted pawl with a spring urging the pawl in contact with teeth of the gear, a gate normally holding the pawl out of contact with the teeth, an inertial member supported relatively movably with respect to the blocking shaft whereby upon increased unrolling velocity the inertial member will change its relative movement and activate the gate member to release the pawl and permit it to engage the teeth of the gear and arrest unrolling of the blind.

5 Claims, 3 Drawing Figures

SAFETY DEVICE FOR ARRESTING UNROLLING OF ROLLER BLINDS

CROSS-REFERENCE TO RELATED APPLICATIONS

This application is a continuation-in-part of application Ser. No. 692,275, filed June 3, 1976, now abandoned.

My U.S. application Ser. No. 692,274, filed June 3, 1977, entitled "Safety Device Protecting Roller Blinds Against Unrolling" is a related application.

BACKGROUND OF THE INVENTION

1. Field of the Invention

This invention relates to roller blinds with a horizontally oriented winding shaft and more particularly refers to a blind with a safety device which blocks the winding shaft in the event of a failure of the support or driving means and arrests unrolling.

2. Description of the Prior Art

Rolling gates and roller blinds with horizontal winding shafts, hereinafter collectively referred to as roller blinds, are known in the art. Unfortunately, failure of the driving mechanism or other support controlling the unrolling of the blind would occur with the result that the blind would make a rapid descent attaining considerable gravitational momentum placing great stress on the parts of the roller blind and often causing appreciable damage to it.

The known safety devices to arrest the winding shaft of the roller blind rely on the use of centrifugal force, which depends on the speed of rotation of the shaft, and requires that it reach a predetermined value which exceeds that of the normal unrolling speed. A necessary condition for this safety device to respond is therefore a sufficient height of fall of the roller blind, that is a height required for the build-up of the necessary centrifugal forces. However, this necessary falling distance which is considerable may already lie in the danger range. In addition, the safety device can be damaged or destroyed by the gravitational momentum of the already unrolled portion of the roller blind.

SUMMARY OF THE INVENTION

An object of the invention is to provide a roller blind having a horizontal winding shaft with a safety device which responds to the angular velocity of the winding shaft, independently of the centrifugal force.

With the foregoing and other objects in view, there is provided in accordance with the invention, a roller blind with a horizontally oriented winding shaft, a safety device for arresting unrolling of the blind in the event of failure of support means for the blind, which includes a concentric blocking shaft affixed to the winding shaft to prevent rotation of the blocking shaft relative to the winding shaft, a gear rigidly fastened to the blocking shaft near its end, a pivotally mounted pawl with a spring urging the pawl in contact with the teeth of the gear, a gate member holding the pawl out of contact with the teeth of the gear during normal unrolling of the blind, an inertial member supported relatively movably with respect to the blocking shaft whereby when the roller blind is rolled down in normal operation the inertial member will not change its relative movement to the blocking shaft but with increased unrolling velocity the inertial member will change its relative movement to the blocking shaft and activate the gate member to permit the pawl to enter in contact with the teeth of the gear and arrest unrolling of the blind.

BRIEF DESCRIPTION OF THE DRAWINGS

Other features which are considered as characteristic for the invention are set forth in the appended claims.

Although the invention is illustrated and described herein as embodied in safety device for arresting unrolling of roller blinds, it is nevertheless not intended to be limited to the details shown, since various modifications and structural changes may be made therein without departing from the spirit of the invention and within the scope and range of equivalents of the claims.

Figure 1:
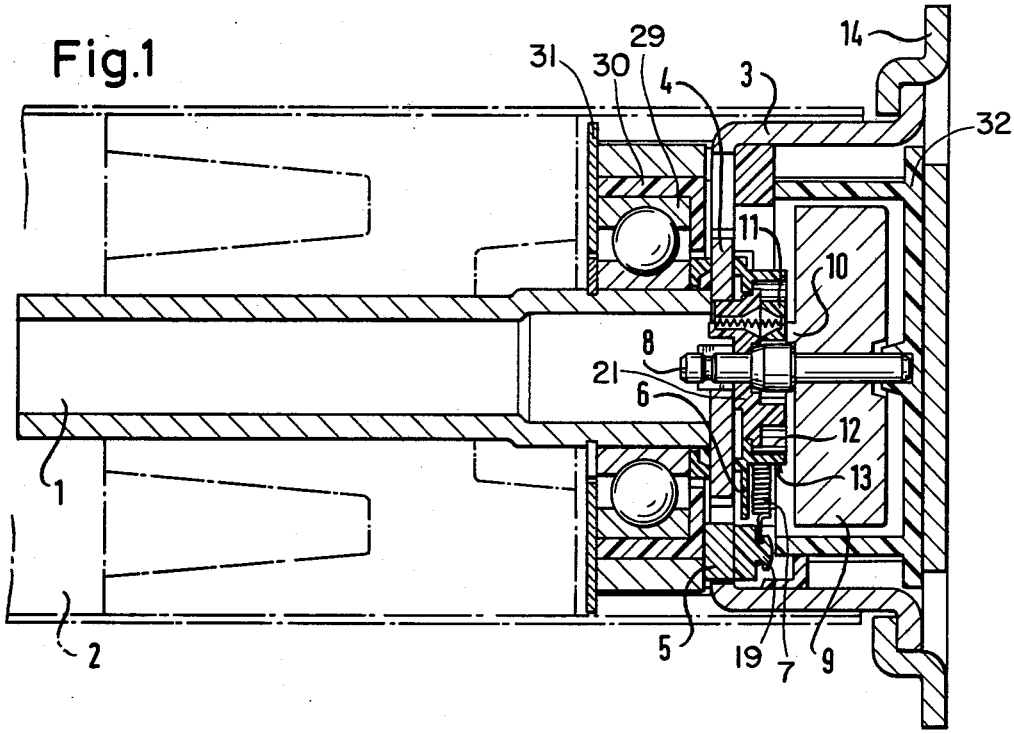
Figure 2:
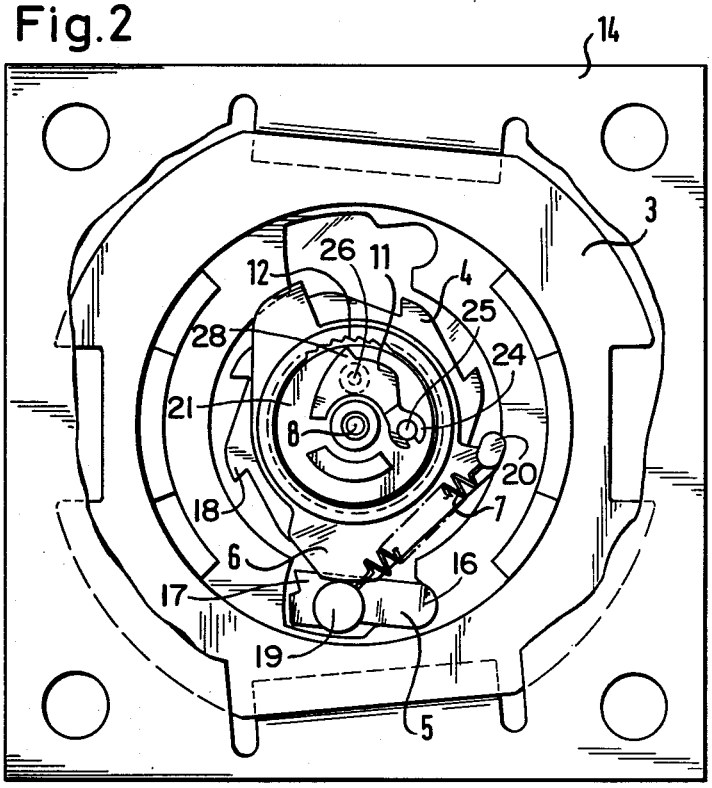
Figure 3:
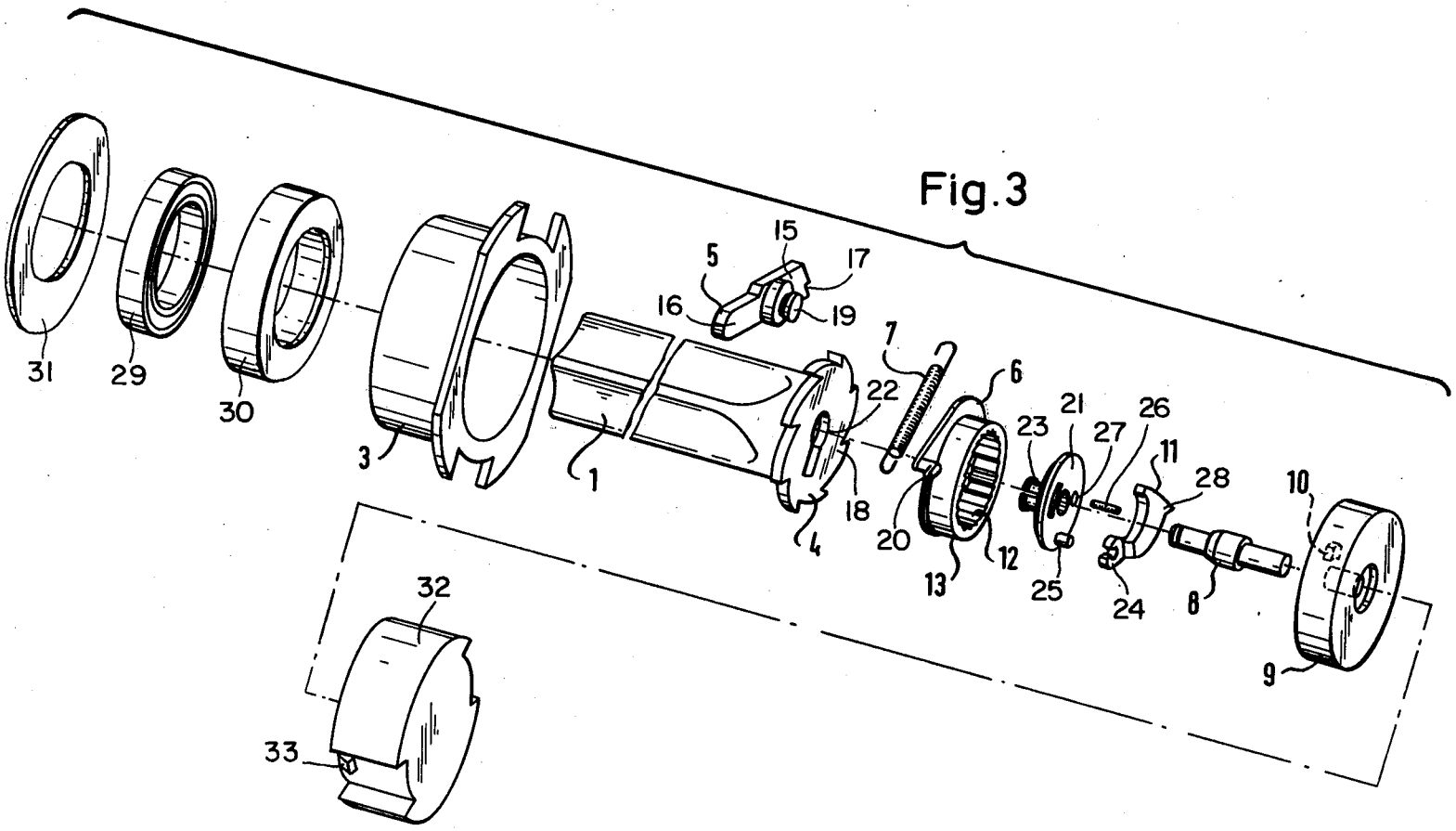

The construction and method of operation of the invention, however, together with additional objects and advantages thereof will be best understood from the following description when read in connection with the accompanying drawings, in which:

FIG. 1 is a side view in cross-section of the safety device of the roller blind; and FIG. 2 shows the end face with the cap removed of the safety device of the roller blind; and FIG. 3 is an exploded view of the safety device of the roller blind.

DETAILED DESCRIPTION OF THE INVENTION

In accordance with the invention, a blocking shaft is coupled to the winding shaft and a gear is rigidly attached to the blocking shaft. In the event of a failure of the support or drive means, a pawl, which is normally held in the rest position against the action of a spring by a gate controlled by an inertial member, engages the gear.

With the arrangement according to the invention, a safety device against unrolling is obtained which does not interfere with the normal unrolling of roller blinds and which responds without material delay if the support or drive means acting on the winding shaft fails.

A further advantage of the arrangement according to the invention is the relatively simple design which, in addition to the economic aspect, reduces the susceptibility to trouble and increases the safety.

In one preferred embodiment of the invention, the inertial member, which is supported relatively rotatably to the blocking shaft, has a projection which acts on a control pawl in such a manner that upon a relative rotation of the inertial member the gate is rotated and thereby, the detent position of the pawl engaging the gear is released. With this embodiment of a safety device, the blocking of the winding shaft is ensured after only a fraction of a revolution of that shaft.

Referring now to the drawings, the safety device against unrolling shown in FIG. 1 is composed of a blocking shaft 1 which is rigidly connected in a suitable manner to the winding shaft 2 of a roller blind, with which support and drive means, not shown, are associated.

A cup-shaped housing 3 is supported at the free end of the blocking shaft 1 which latter is freely movable relative to housing 3. The cup-shaped housing 3 contains a gear or ratchet wheel 4 rigidly coupled to the blocking shaft 1. A pawl 5 is pivoted at the housing, which pawl 5 is engaged with the gear 4 in the event of danger, e.g., if the support or drive means fail, and thereby arrests the blocking shaft 1, and which is held in the rest position against the action of a spring 7 by a gate 6 shwon in FIG. 2. The pawl 5 shown in greater detail in FIG. 3 has a wider portion 15 and a narrower portion 16 with a curved end which permits pivoting the pawl 5 around the curved end. The other end of the pawl 5 has an edge 17 which when pawl 5 is pivoted out of its normal resting position engages teeth 18 of gear wheel 4 thereby preventing further rotation of gear wheel 4 and blocking shaft 1 to which it is firmly attached as well as winding shaft 2 of the roller blind thereby preventing further unrolling of the roller blind. Disposed on top of the pawl 5 at a distance from curved end 16 is a knob 19 to which is attached one end of spring 7. Normally the outward pivotal movement of pawl 5 is blocked by cam member 6 as seen in FIG. 2, but with unblocking due to rapid descent of the blind as explained later, the spring 7 attached to knob 19 pulls on pawl 5 so that it pivots around its end 16 and its other end with edge 17 moves out and engages tooth 18 of gear wheel 4. Pawl 5 as seen in FIG. 2 fits in a cut-out of the housing 3 which as a curvature into which curved end 16 of pawl 5 fits. The housing 3 is stationary, consequently pawl 5 which is fitted in housing 3 is also stationary except to the extent of pivoting around end 16 to engage with edge 17 the teeth 18 of pawl 5. When teeth 18 are engaged, the gear 4 cannot continue to rotate being impeded by pawl 5 fixed in housing 3. Towards the front of shaft 1 facing the ratchet wheel 4, is gate or cam member 6. Extending from cam memer 6 is hook 20 to which is attached the other end of spring 7. Cam member 6 has a circular shoulder 13 which is provided with internal gear teeth 12. An intermediate member 21 is arranged in the space which is enclosed by collar 13 with a small clearance between them to permit rotation of the intermediate member 21 without rotation of cam member 6 which connected to spring 7 normally remains in stationary or rest position blocking pawl 5. The intermediate member 21 is unrotatably connected with shaft 1, i.e. it will not rotate relative to shaft 1, by inserting into keyhole-shaped opening 22 of gear wheel 4, a corresponding keyhole-shaped projection 23 extending from intermediate member 21. The control pawl 11 is hingeably disposed by placing one end 24 on a pivot pin 25 of the intermediate member 21. The control pawl 11 is held in normal position and when extended returned to normal position by means of spring post 26 which has one end extending into hole 27 of intermediate member 21 and the other end extending into a corresponding hole, not shown, in control pawl 11. Thus when control-pawl 11 moves out, pivoting on pin 25, its tooth-shaped part 28 engages internal gear teeth 12 causing cam member 6 to rotate a short distance moving it out of locking position of pawl 5 which then moves out and engages teeth 18 of wheel 4 thereby stopping further rotation. One end of extension shaft 8 extends through a central opening in projection 23 and a disc-shaped inertia member 9 is rotatably arranged at the outer end of the extension shaft 8, as shown in FIG. 1. The inertia member 9 is provided with a projection 10 which moves the locking pawl 11 when the inertial member 9 is rotated relative to shaft 1, so that the tooth-shaped part 28 of the pawl 11 can engage the internal gear teeth 12. This arrests the blocking shaft 1 and of course the winding shaft 2 being connected via the blocking shaft 1. The pawl 5 is fitted in the housing 3 connected to a support plate 14.

A bearing 29 and lining 30 between bearing 29 and housing 3 are inserted into one end of the housing 3 as shown in FIGS. 1 and 3 to support blocking shaft 1 and permit it to freely rotate in the housing. A plate 31 shown in FIG. 1 may be used to close off that end of the housing. The other end of the housing 3 may be closed off by cover cap 32 shown in FIGS. 3 and 1. Projections 33 on cap 32 may be employed to fit in indentations in housing 3, not shown in the drawing, to retain cover cap 32 in place.

As soon as the blocking shaft 1 exceeds a speed of rotation at which the angular velocity of the inertial member 9 lags behind that of the blocking shaft 1, the projection 10 of the latter rotates the control pawl 11 and thereby initiates the arrest of the blocking shaft 1. If the speed of rotation remains in the normal range, the inertial member 9 is carried along with the extension 8, so that no blocking occurs. Normally the cam member 6 attached to pawl 5 by spring 7 does not rotate since the clearance between internal gear teeth 12 and intermediate member 21 is sufficient to permit the latter to rotate without engaging the former. A pawl 5 is hingeably positioned in stationary housing 3 and coupled with cam member 6 by spring 7. When the blocking shaft is turned clockwise (FIG. 2), cam member 6 is positioned under the pawl 5, so that the latter does not act. This rotational direction of the blocking shaft corresponds to the roller blind axle during the winding up operation. When the blocking shaft 1 moves in the opposite rotational direction, the blocking device is also effective as long as the rotation does not exceed a certain speed. This corresponds to the normal unrolling of the roller blind. Thus under normal conditions cam member 6 blocks the action of pawl 5 to engage ratchet wheel 4 as seen in FIG. 2. Now, if the drive means fail either during raising or lowering of the roller blind or also in the rest position, the roller blind will unroll very quickly because of its weight and thereby cause rapid rotation of the blocking shaft 1 (counter-clockwise). The inertia member 9 thereby lags behind the blocking shaft 1 and also lags behind intermediate member 21 attached to blocking shaft 1. As a result of this lag, projection 10 of inertia member 9 disposed next to the free end of the control pawl 11 causes the pawl to move out a distance, pivoting on pin 25, so that its tooth-shaped part 28 engages the internal gear teeth 12. Since control pawl 11 is connected to shaft 1 and must rotate with it, the engagement of internal gear teeth 12 causes cam member 6 to turn counter-clockwise with blocking shaft 1. Buy this rotation of less than one-fourth turn, cam 6 moves from its position preventing pawl 5 from moving. Pawl 5 is thereby released from cam member 6 and urged by spring 7 in contact with ratchet wheel 4. By this action, the blocking shaft is locked (arrested). By rotating the blocking shaft in the clockwise direction, the locking action is again released.

There are claimed:

1. In a roller blind with a horizontally oriented winding shaft, a safety device for arresting unrolling of the blind in the event of failure of support means for the blind, which comprises a concentric blocking shaft affixed to the winding shaft to prevent rotation of the blocking shaft relative to the winding shaft, a gear rigidly fastened to the blocking shaft near its end, a pivotally mounted pawl with a spring urging the pawl in contact with the teeth of said gear, a gate member holding the pawl out of contact with the teeth of the gear during normal unrolling of the blind, an inertial member supported relatively movably with respect to the blocking shaft whereby when said roller blind is rolled down in normal operation said inertial member will not change its relative movement to the blocking shaft but with increased unrolling velocity said inertial member will change its relative movement to the blocking shaft and activate said gate member to permit the pawl to enter in contact with the teeth of said gear and arrest unrolling of the blind.

2. Roller blind with safety device according to claim 1, wherein said inertial member has a projection which upon a relative rotation of the inertial member due to increased unrolling velocity, the projection acts on a control pawl which normally rotates with the winding shaft, to rotate the control pawl which rotates the gate, which latter releases the pawl to enter into contact with the teeth of said gear.

3. Roller blind with safety device according to claim 1, wherein a housing which can be mounted in a stationary position is disposed around said inertial member and pawl with said pawl pivoted at said housing whereby the unrolling forces in the event of failure of support means for the blind is taken up by the stationary housing.

4. Roller blind with a safety device according to claim 1, wherein an extension member extends from said blocking shaft and wherein said inertial member is mounted on said extension member.

5. Roller blind with a safety device according to claim 2, wherein said gate has connected to it a circular shoulder with inner teeth, and wherein said control pawl engages said inner teeth of said shoulder to rotate said gate which releases said pivotally mounted pawl permitting it to engage the teeth of said gear fastened to said blocking shaft.

* * * * *